US008396400B2

(12) United States Patent
Brown et al.

(10) Patent No.: US 8,396,400 B2
(45) Date of Patent: Mar. 12, 2013

(54) METHOD OF IMPLEMENTING A MAGNETICALLY ACTUATED FLAP SEAL

(75) Inventors: Kenneth J. Brown, Penfield, NY (US); Donald S. Rimai, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 266 days.

(21) Appl. No.: 12/887,786

(22) Filed: Sep. 22, 2010

(65) Prior Publication Data

US 2012/0070198 A1 Mar. 22, 2012

(51) Int. Cl.
*G03G 21/00* (2006.01)

(52) U.S. Cl. ..... 399/273

(58) Field of Classification Search ..... 399/273, 399/283, 264

See application file for complete search history.

(56) References Cited

U.S. PATENT DOCUMENTS

| | | | | |
|---|---|---|---|---|
| 4,181,422 | A * | 1/1980 | Forgo et al. | 399/149 |
| 2006/0013626 | A1 * | 1/2006 | Hart | 399/350 |
| 2009/0097893 | A1 * | 4/2009 | Kiuchi et al. | 399/350 |

FOREIGN PATENT DOCUMENTS

| | | | |
|---|---|---|---|
| JP | 56144472 | A * | 11/1981 |
| JP | 07175328 | A * | 7/1995 |
| JP | 09258559 | A * | 10/1997 |
| JP | 10198246 | A * | 7/1998 |

* cited by examiner

*Primary Examiner* — Quana M Grainger
(74) *Attorney, Agent, or Firm* — Raymond L. Owens

(57) ABSTRACT

A method for removing carrier buildup in a slotted scavenger electrode in a printer comprising magnetically attracting the carrier toward the slot, blocking the slot with a movable flap for preventing toner dust from traveling through the slot, opening the movable flap for allowing the carrier to travel through the slot and return to the developer station, then reclosing the movable flap.

18 Claims, 9 Drawing Sheets

METHOD OF IMPLEMENTING A MAGNETICALLY ACTUATED FLAP SEAL

CROSS REFERENCE TO RELATED APPLICATION

Reference is made to commonly assigned, co-pending U.S. patent applications:

Ser. No. 12/887,805 by Brown et al., filed of even date herewith entitled, "Magnetically Actuated Flap Seal";

Ser. No. 12/827,261 by Brown et al. filed Jun. 30, 2010 entitled "Printer Having An Alternate Scavenger Geometry";

Ser. No. 12/827,305 by Brown et al. filed Jun. 30, 2010 entitled "Fabrication Of An Alternate Scavenger Geometry"; and Ser. No. 12/859,549 by Brown et al. filed Aug. 19, 2010 entitled "An Alternate Scavenger Geometry that Promotes Carrier Return Back Into the Development Station", the disclosures of which are incorporated herein by reference in their entireties.

FIELD OF THE INVENTION

The present invention pertains to electrographic printers and copiers utilizing developer comprising toner, carrier, and other components.

BACKGROUND OF THE INVENTION

Electrographic printers and copiers utilizing developer comprising toner, carrier, and other components use a developer mixing apparatus and related processes for mixing the developer and toner used during the printing process. As is well known, the carrier can comprise permanently magnetized ferrite core particles, dispersed in a developer station with toner, whereupon the toner is attracted to and is carried by the ferrite core to an imaging roller for printing on a print medium. The gram weight of the carrier can be approximately 6-8% of the toner, which together comprises the developer. As part of this process, the carrier is intended to be reused and recirculated within the developer station. Certain conditions will cause the carrier to leave the developer station and deposit on the surface of the imaging member. Typically, there exists an electrically biased electrode 103 (the scavenger electrode), as shown in FIG. 1 that urges this carrier off the surface of the imaging member 102 because the biasing induces magnetism in the electrode, whereupon the magnetic force of the development roller 101 will direct the carrier, under gravity, back into the development station substantially in the general direction 105. The scavenger is electrically biased via a combination of high frequency AC imposed on a DC waveform whose function is to provide the motive force for the movement of carrier off of the photoconductor surface. Under the alternating AC field, the carrier rocks free and breaks from the photoconductor surface. The magnetic field from the rotating core magnet then pulls the carrier particle through the slotted scavenger back into the developer station.

There are conditions, however, that result in the release of the carrier from the imaging (photoconductor) member 102, but the trajectory of the carrier is such that it will overshoot the trailing edge of the electrode 103. This can result in carrier accumulating, shown as 204 in FIG. 2, on the outside vertical face of the scavenger electrode 203 or other surfaces, such as on the outer surfaces of the developer station or other surfaces in the imaging engine. Since this carrier is intended to be reused within the developer station, the loss of carrier can result in degradation of the image due to compromised mixing in developer sump. This carrier loss can also accumulate to the point where this carrier mass 204 can make contact with the imaging member 202, thereby physically disrupting the image, resulting in a loss of image quality. The preferred solution for this problem involves cutting slots into the vertical face of the scavenger electrode, such that the scavenged carrier can return to the development station. These slots can create a problem, because toner dust from the interior of the development station can escape 1301, causing increased maintenance of the imaging engine, higher cost of ownership due to the loss of the toner, and degradation of image quality.

SUMMARY OF THE INVENTION

The problem as explained above can be solved by the addition of a flap or door or some other device that covers the slot or slots. The force required to open the slot is provided by the magnetic coupling between the magnetic carrier on one side of the flap and the developer roller magnet on the other side of the flap, although another source of opening or closing force, or both, can be used. A preferred embodiment of the present invention is realized in a method for removing a buildup of a carrier on a scavenger electrode that includes providing a slotted scavenger electrode for collecting the carrier, magnetically directing the carrier toward the slot, at least partially blocking the slot with a flap, which can be a flexible flap or rigid. By accumulating the carrier buildup to a volume sufficient for opening the flap, due to magnetic attractive force increasing for a greater volume, it opens the flap, either by flexing a flexible flap or by rotating a rigid flap, and allows the carrier to travel through the slot. Closing the flap after allowing the carrier to travel through the slot prevents toner dust from an interior region of the printer from passing through the slot in a direction opposite the direction of the carrier traveling through the slot toward the developer station. The flap can be affixed, attached, or connected to the scavenger electrode using any variety of elements such as an adhesive, adhesive tape, nails, rivets, screws, or a hinge. Similarly, the flap can be connected to any of a variety of elements to open or close the flap, such as a spring, a mechanized (motor driven) arm, etc. Blocking the slot can alternatively include completely covering, or sealing, or both, the slot with the flap. The magnetic field is preferably imposed at an angle as close as feasible to about 90° to the flap. A strength of the magnetic field should be about 500 to 700 gauss as measured at the flap. A flexible flap embodiment can take advantage of flap deformation to open the flap, thereby allowing the flap to close by returning to its resting position.

Another preferred embodiment of the present invention includes a method for removing a buildup of a carrier on a scavenger electrode comprising the steps of providing a slotted scavenger electrode for collecting the carrier, magnetically attracting the carrier in a first direction toward the slot in the scavenger electrode, blocking the slot with a movable flap for preventing toner dust from traveling through the slot in a second direction and for temporarily preventing the carrier from traveling through the slot in the first direction, and opening the movable flap including unblocking the slot and allowing the carrier to travel through the slot by magnetically attracting the carrier. The flap is closed of claim 11 after allowing the carrier to travel through the slot and return to the developer station. As before, the step of opening the movable flap can make use of the magnetic attraction between the development roller and the accumulating carrier buildup until the carrier volume becomes sufficient for the magnitude of the magnetic attraction to force open the movable flap.

These, and other, aspects and objects of the present invention will be better appreciated and understood when considered in conjunction with the following description and the accompanying drawings. It should be understood, however, that the following description, while indicating preferred embodiments of the present invention and numerous specific details thereof, is given by way of illustration and not of limitation. For example, the summary descriptions above are not meant to describe individual separate embodiments whose elements are not interchangeable. In fact, many of the elements described as related to a particular embodiment can be used together with, and possibly interchanged with, elements of other described embodiments. Many changes and modifications may be made within the scope of the present invention without departing from the spirit thereof, and the invention includes all such modifications. The figures below are intended to be drawn neither to any precise scale with respect to relative size, angular relationship, or relative position nor to any combinational relationship with respect to interchangeability, substitution, or representation of an actual implementation.

DETAILED DESCRIPTION OF THE INVENTION

Figure 1:
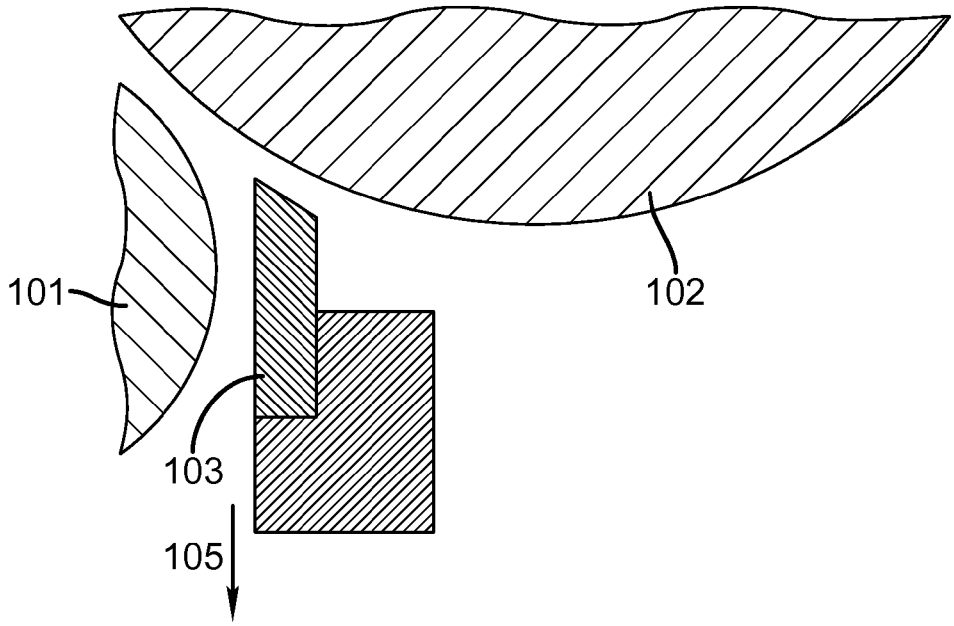
FIG. 1: Depiction of carrier scavenger electrode and electrostatographic module components.
Figure 2:
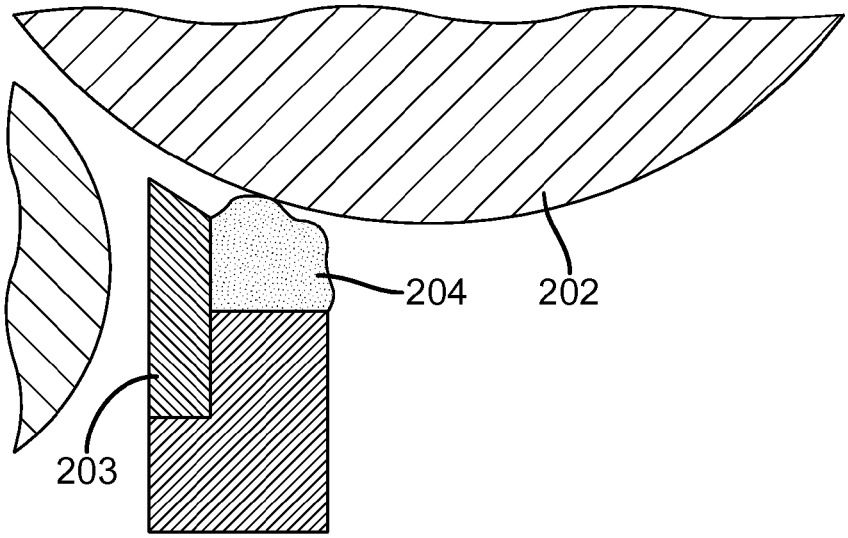
FIG. 2: Scavenger electrode showing carrier buildup.
Figure 3:
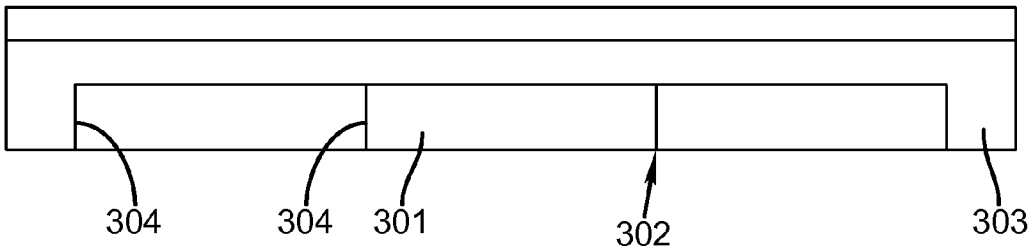
FIG. 3: Depiction of horizontal slots cut into vertical face of the scavenger electrode.

A preferred embodiment of the present invention provides return of carrier back into a printer's developer station by forming horizontal slots (separated by inter slot webs) through the vertical face of the scavenger electrode, as illustrated in FIG. 3 which shows a front view of the scavenger electrode as seen while looking at the outside vertical face 303. A preferred embodiment of these slots 301, having sidewalls 304, formed through the scavenger electrode comprise slots defined as follows:

Slot (sidewall) height: range from 3.2 mm to 5.5 mm, or 36% to 61% of the vertical face height of the Scavenger Electrode (approx. 9 mm vertical wall height). The interior and exterior vertical faces of the slots can be referred to as sidewalls.

Slot Width: range of 20 mm-30 mm.

Total slot area is 20%-30% of the total area of the inside vertical face of the scavenger electrode. Carrier buildup on the outside vertical face of the scavenger electrode is minimized by reducing the projected area of the inter slot web 302 on the outside vertical face. Scavenger stiffness is increased by maximizing the projected area of the inter slot web's inside vertical face of the scavenger electrode, as will be explained.

Figure 4B:
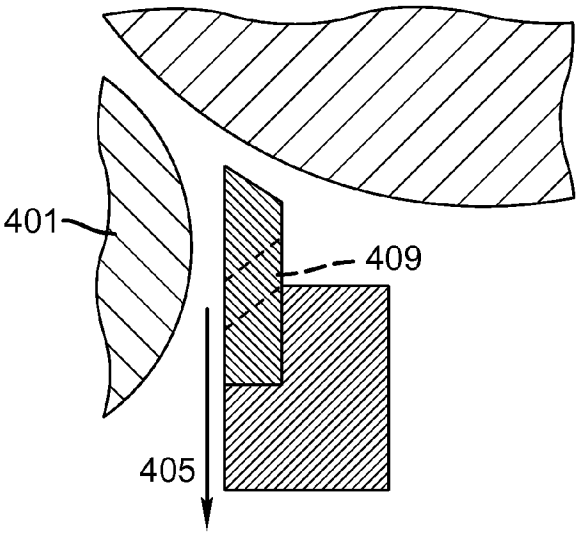
FIGS. 4A-B: Depiction of inside and outside vertical surfaces of the scavenger electrode and slot form options.
Figure 4A:
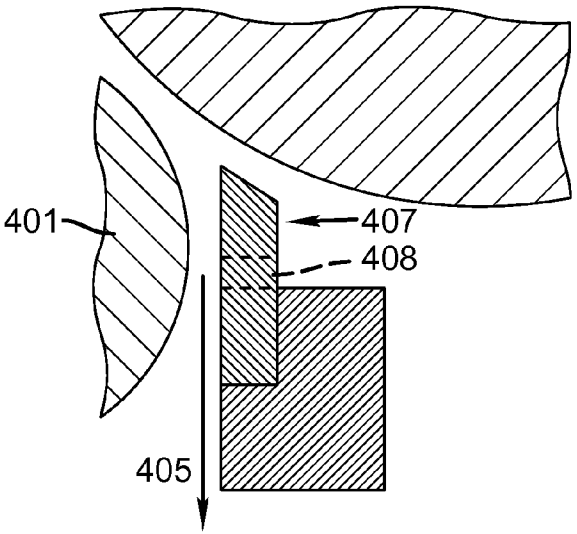
Figure 5:
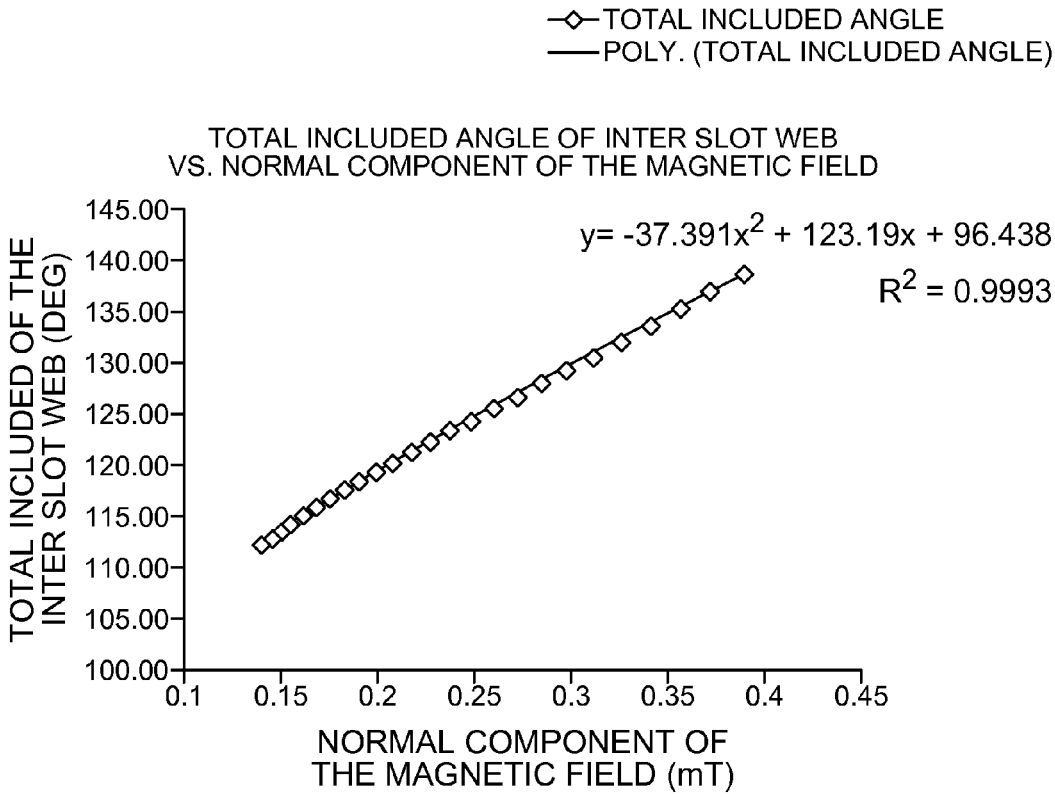
FIG. 5: Graph of inter slot web angle vs. magnetic field.

Referring to FIG. 4A, buildup of carrier on the outside vertical face 407 of the scavenger electrode is minimized when the total included angle of the inter slot web is proportional to the normal component of the magnetic field imposed by the development roller 401 on the built up carrier. This draws the carrier along a pathway from where the carrier accumulates 204 through the slots 408 which is then returned by earth gravitational force in direction 405 back to the developer station. An optional slot configuration is illustrated in FIG. 4B wherein the slot 409 is angled downward which requires less attractive force from the magnetic field provided by the development roller 401 to move the carrier out of the scavenger in the direction 405. This is due to gravity acting on the carrier and causing the carrier to travel through the slot. The magnetic field imposed by the development roller 401 is sufficiently described, with $R^2$=99.93%, per the following equation, supported by data shown in FIG. 5.

$$TIA=-37.391\times FIELD^2+123.91\times FIELD+96.438,$$

where

TIA=Total Included Angle (in Degrees)

Field=Normal Component of Magnetic Field (in mT)

where TIA≦139 Deg

Figure 6:
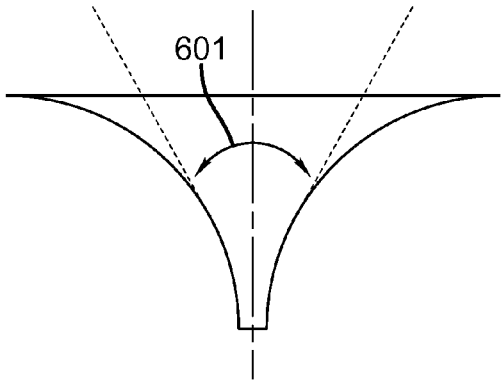
FIG. 6: Depiction of total included angle of inter slot web.

The total included angle 601 is measured rail to rail as shown in FIG. 6 which illustrates a top view of a single inter slot web.

Figure 7:
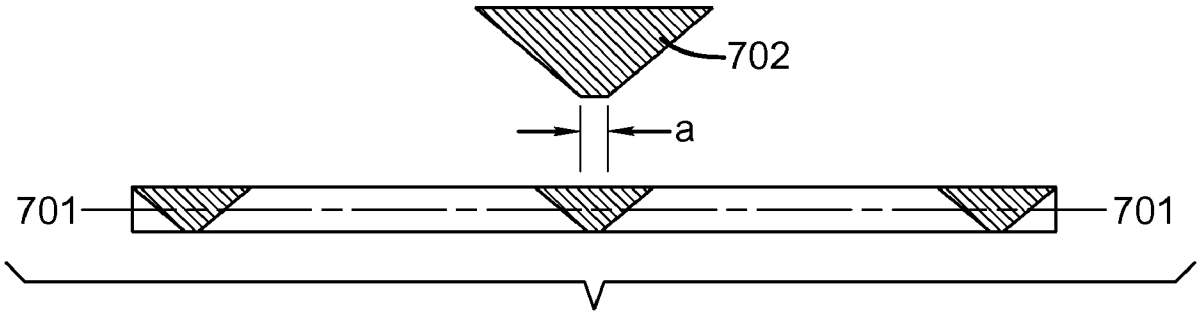
FIG. 7: Specification for inter web slots of a trapezoidal design.

In general, slots that use a trapezoidal geometry for the inter slot web can partially satisfy the requirements of returning carrier back into the developer station, minimizing carrier buildup on the outside vertical face of the scavenger electrode, and increasing overall stiffness of the scavenger as compared to an inter slot web having a constant thickness. The requirements for the trapezoidal geometry of the inter slot web are described as follows and are shown in the top view of the scavenger electrode depicted in FIG. 7. The 'a' dimension of the trapezoid 702 faces the outside vertical face of the scavenger electrode. The length of the 'a' dimension is preferably less than or equal to about 1.5 mm. The total calculated moment of inertia about the specified axis of interest 701, as illustrated in FIG. 7 for the inter slot web should be about 58 mm^4. The total included angle of the inter slot web geometry provided by the trapezoidal inter slot web should partially satisfy requirements for allowing a return of built up carrier to the developer station.

Figure 8:
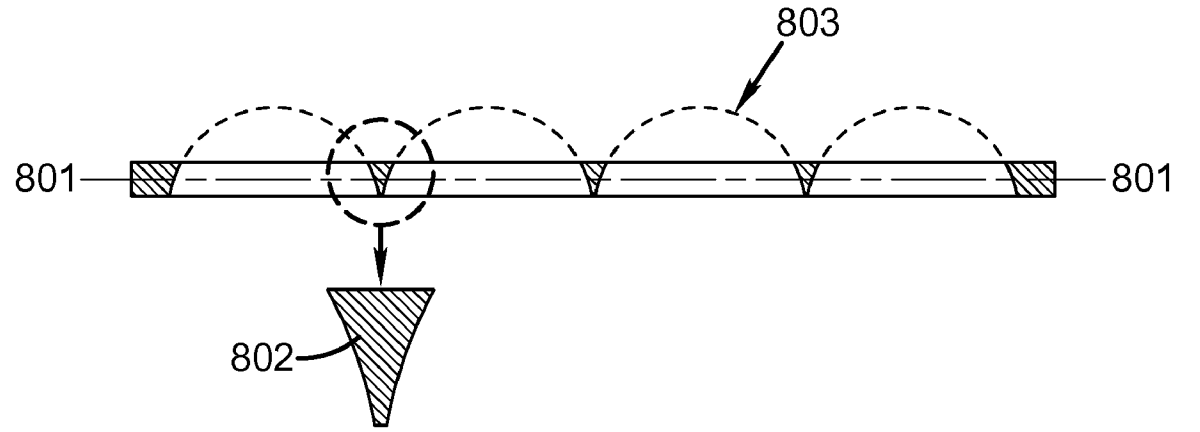
FIG. 8: Top view of scavenger electrode showing slot geometry.
Figure 9:
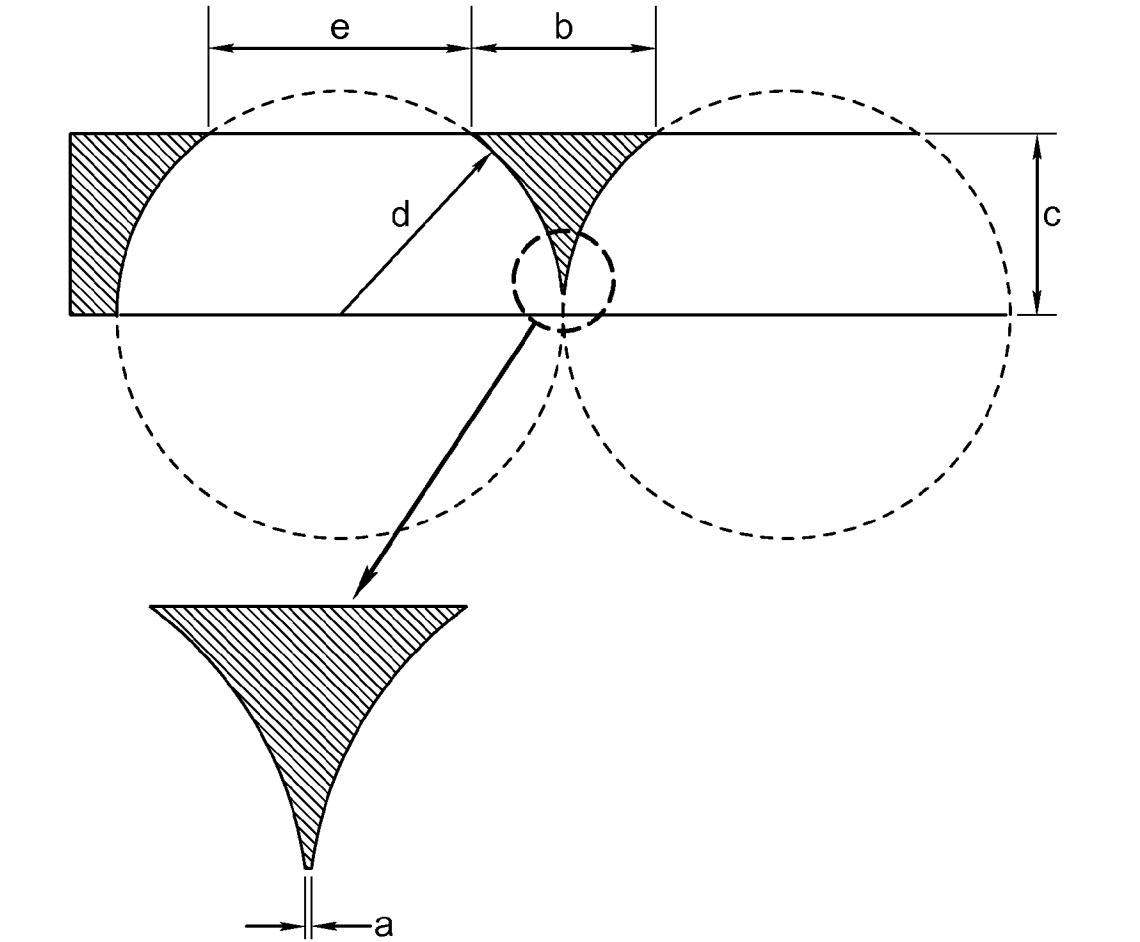
FIG. 9: Specification drawing for slots of a cycloidal design.

Another preferred embodiment of the inter slot web is to cut or form openings in a fashion that describes a cycloid (cusp at origin) such as illustrated in FIG. 6, depicted in greater detail in FIGS. 8 and 9, with the addition of the following.

The profile of the inter slot web is thinner than the equivalent trapezoidal inter slot web towards the outside vertical face of the scavenger electrode, which further discourages carrier buildup on the outside face of the scavenger electrode because the favorable cycloidal geometry presents less resistance to the carrier when it is drawn through the slots by magnetic force from the development roller. This can be seen by comparing FIG. 7 with FIG. 8 where the cycloid inter slot web 802 is thinner in the trapezoidal inter slot web 702 "a" dimension. The cycloidal slots 803 are defined by the following dimensions, with reference to FIG. 9 which shows a top view of the scavenger electrode:

In an experimental laboratory construction, the following dimensions were found to provide improved scavenger performance. The 'a' dimension is of the apex of the inter slot web that faces the outside vertical edge of the scavenger electrode. The length of the 'a' dimension should be less than or equal to about 1.5 mm, but within a range of about 1-2 mm. The 'b' dimension should be about 49.2 mm, but within a range of about 47-52 mm; the 'c' dimension should be about 4.78 mm, but within a range of abut 3-6 mm; and the 'd' dimension should be about 50.8 mm, but within about 47-53 mm. Slot height can range from about 3 mm to about 6 mm (36% to 61%) of the vertical face of the scavenger electrode (approx. 9 mm vertical wall height). Slot width (dimension 'e') ranges from about 20-30 mm. Total slot area should be about 20%-30% of the total area of the vertical face of the scavenger. The total calculated moment of inertia about the specified axis of interest 801 for the inter slot should be about 58 min^4, as depicted in FIG. 8. The dimensions just described were measured for a scavenger electrode manufactured for a printer having a size of approximately 454 mm in length. The length of the scavenger is consistent with the maximum imaging width of the particular print process, and should not be considered as required dimensions for implementations in any other printer.

Figure 10:
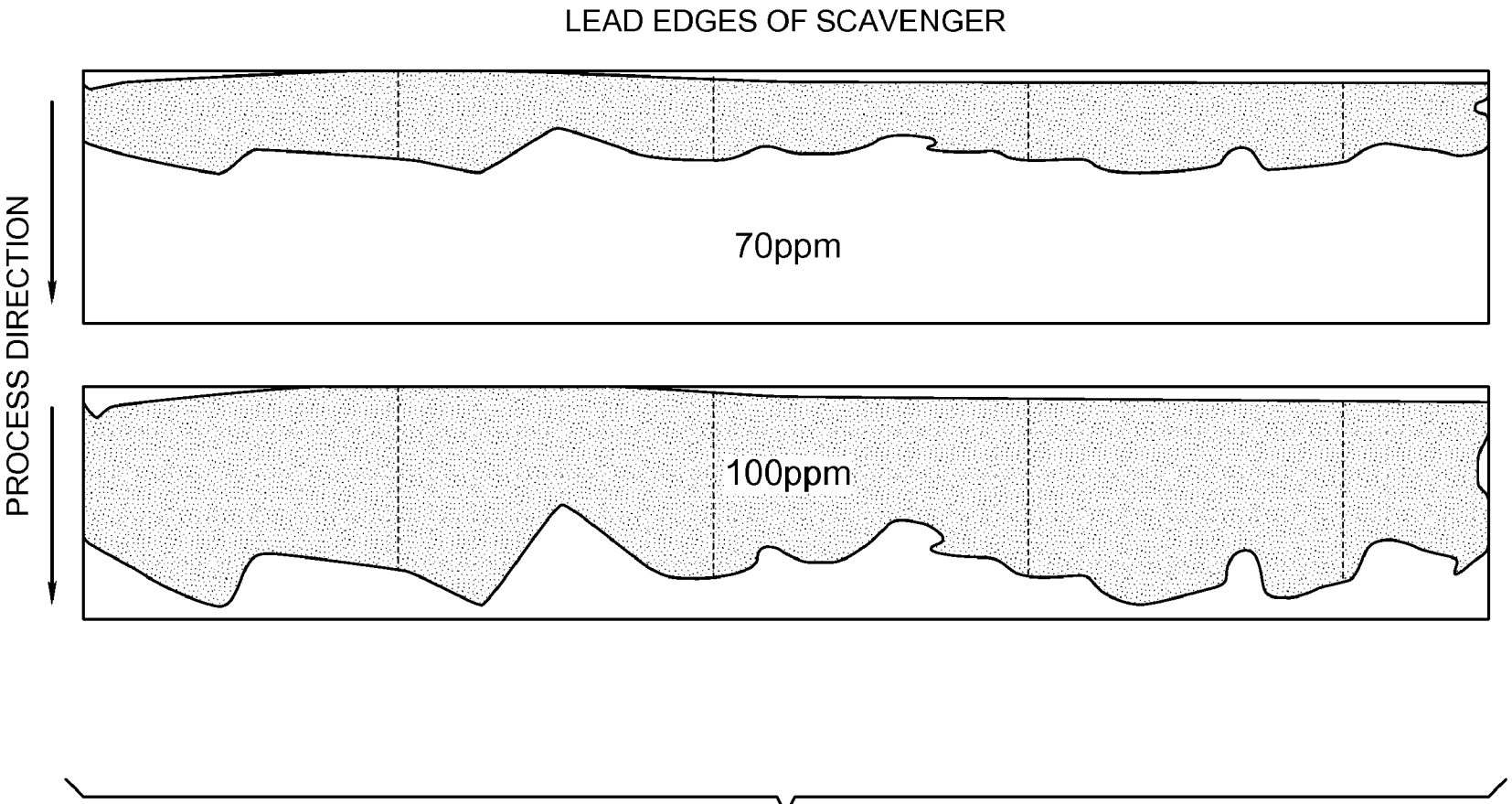
FIG. 10: Depiction of how carrier covers a greater area of the electrode surface when process speed is increased.

In a two component development system, some loss of carrier is inevitable, and management of carrier loss turns out to be a very important part of the development station design. Specifically, the need to effectively scavenge escaping carrier and return it back to the development station is crucial to the overall life of the developer. It has been shown that as the speed of the electrostatographic process is increased, the trajectory of the carrier is such that it landed farther downstream from the developer station resulting in increased build up, as depicted in FIG. 10, which depicts build up amounts for print speeds of 70 ppm and 100 ppm (pages per minute).

It is essential to place the scavenger electrode at the point where the influence of the developer station magnet is such that it could no longer urge the carrier back into the developer station. As the speed of the process continues to increase, the trajectory of the carrier is such that a large portion of the scavenged carrier lands far past the trail edge of the scavenger electrode. This results in carrier accumulating on the scavenger and associated mounting surfaces, and results in increased maintenance and eventual degradation in image quality. The mass of escaping carrier is such that a simple strategy of placing a tray downstream of the developer station to catch and collect the carrier is unmanageable, since it is not guaranteed that escaping carrier caught in the external tray would be returned to the developer station. A practical solution requires that the majority of this escaping carrier be returned back to the developer station.

Figure 11:
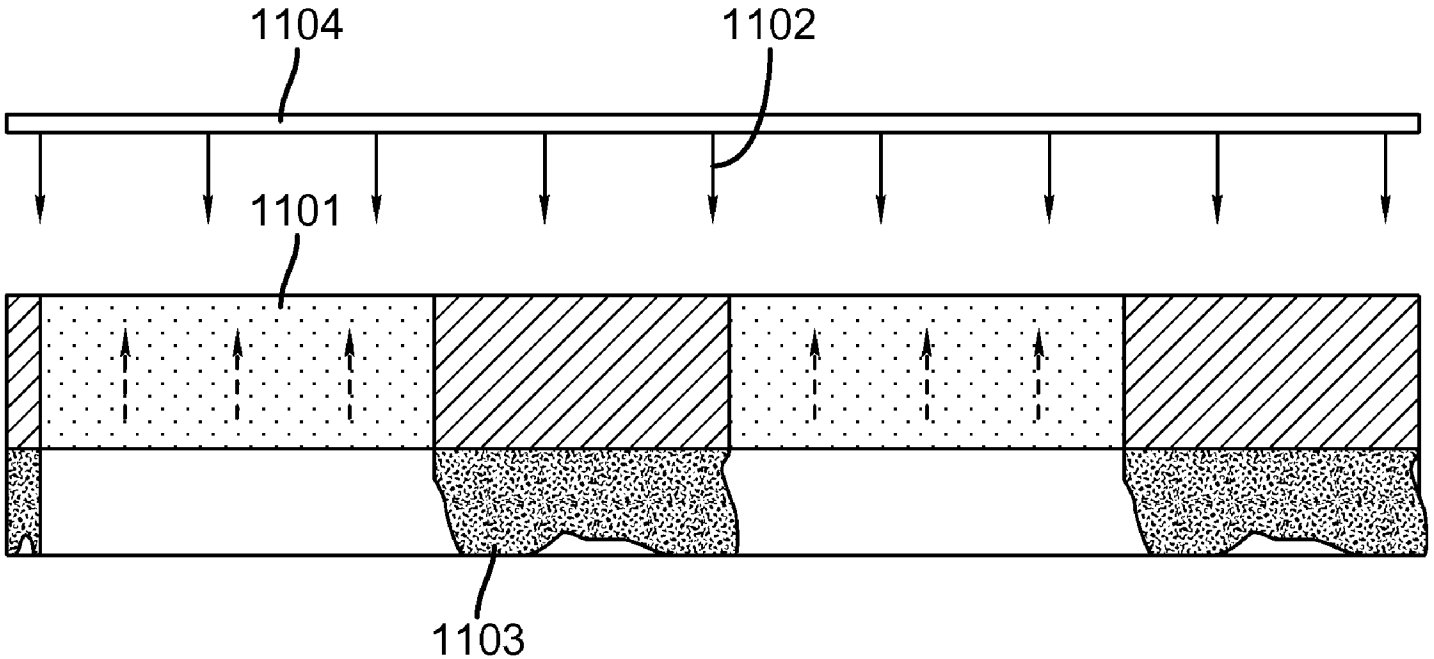
FIG. 11: Depiction of carrier buildup on inter slot webs.

Initial attempts at a solution involved drilling holes and cutting slots into the vertical face of the scavenger electrode. This resulted in a vast majority of the carrier returning back to the developer station. This design was not completely effective, because the inter slot web areas accumulated carrier to the point where it would make contact with the imaging member surface, causing an image defect. With reference to FIG. 11, this geometry for the inter slot web was ineffective because the magnetic field 1102 is normal to the vertical surface of the scavenger, such that there is no force to urge the carrier 1103 to move in the transverse direction (along the face of the scavenger electrode). The carrier is urged in the direction 1101 through the slot by the magnetic field. Thus, the carrier is held tight on the horizontal face of the inter slot web, as depicted in FIG. 11.

Figure 12:
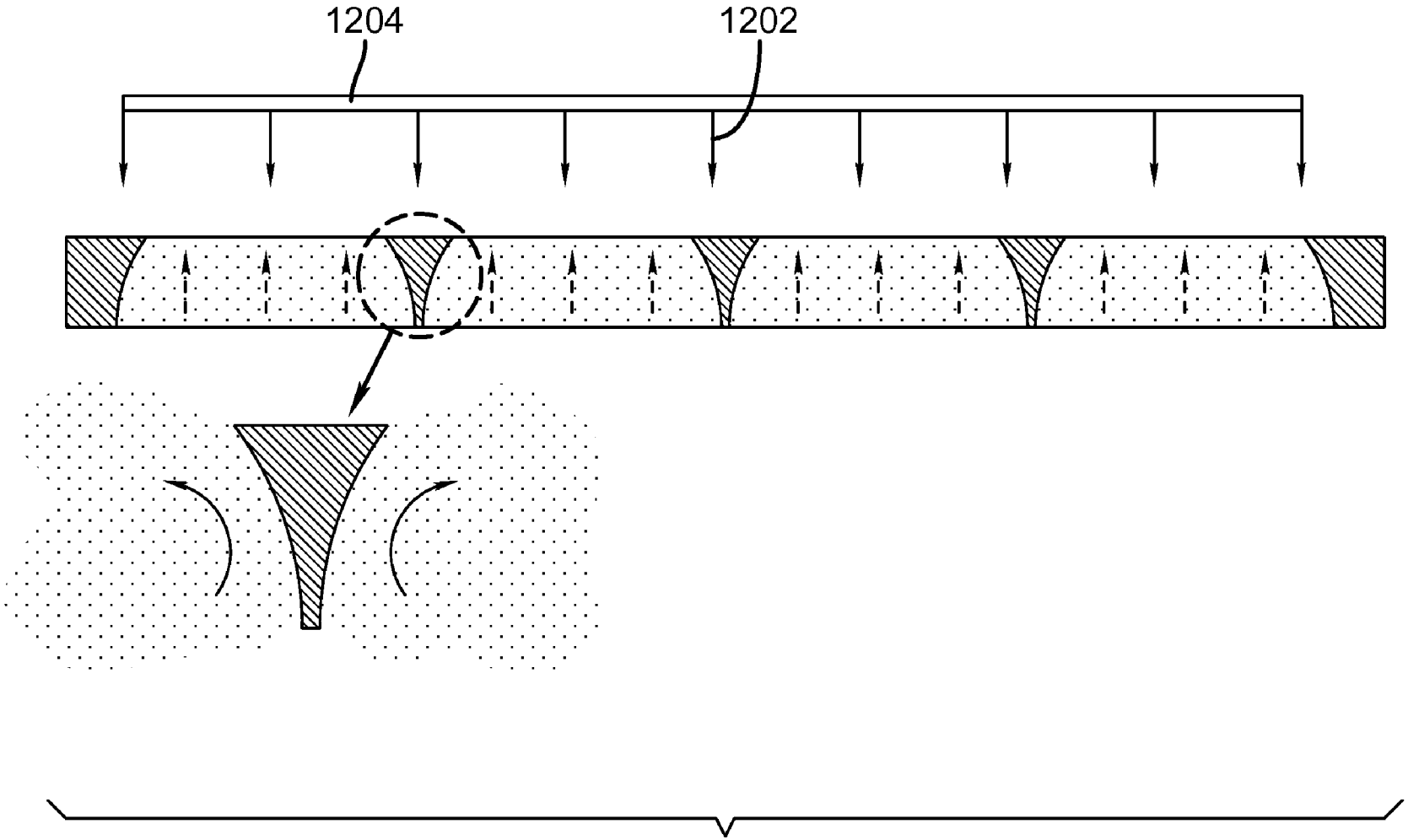
FIG. 12: Depiction of improved geometry.

With reference to FIG. 12, the addition of the cycloidal inter slot web urges the carrier in transverse direction (along the length of the cycloidal inter slot web) and through the openings, allowing for the proper return of carrier back into the development station. The angle of the inter slot web increases and approaches an angle normal to the magnetic field where the magnetic field is stronger and able to overcome this increased resistance. Where the magnetic field is weaker, near the apex of the inter slot web, the inter slot web geometry is almost parallel to the magnetic field lines and provides very little resistance to the movement of the carrier. This geometry also preserves the required rigidity and stiffness of the scavenger electrode over other web geometries. In particular, the wider profile of the inter slot web on the inside surface of the scavenger provides this increased rigidity. With the geometry described by the present invention, this buildup is substantially eliminated.

Figure 13:
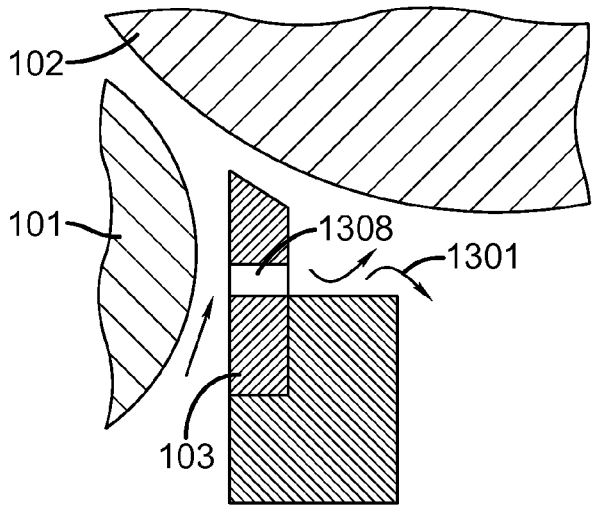
FIG. 13: Depiction of toner dust traveling through the slot.

With reference to FIG. 13, there is illustrated a potential condition which may occur in the presently described implementation of a slotted scavenger. The slots can create a problem because toner dust from the interior of the development station can escape 1301, for example, through the slot 1308, causing increased maintenance of the imaging engine, higher cost of ownership due to the loss of the toner, and degradation of image quality.

Figure 14:
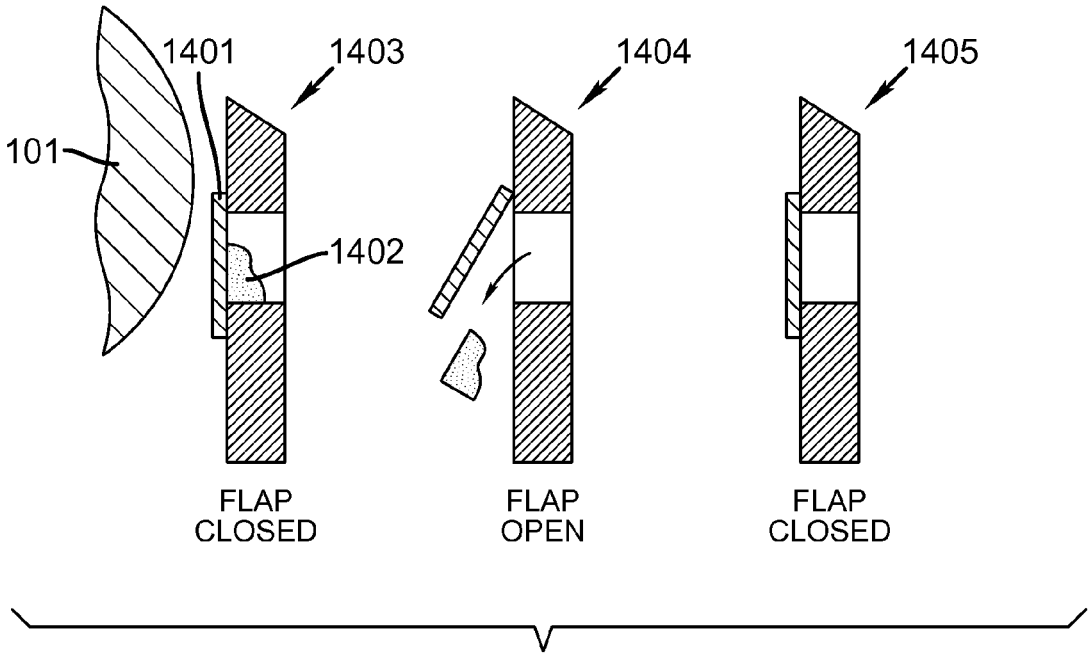
FIG. 14: Depiction of flap opening and closing when carrier to developer roller coupling force exceeds the force needed to open the flap.

A solution to this potential problem is solved in a preferred embodiment of the present invention illustrated in FIG. 14. A flexible or movable flap 1401, or flexible or movable door, which may alternatively be rigid, is secured to the scavenger electrode 1403 to at least partially block or else to completely cover the slot or slots on the interior side of the scavenger electrode. The force required to flexibly open an unmechanized, or flexible, or rigid movable flap is provided by the magnetic coupling between the magnetic carrier 1402 on one side of the flap, and the developer roller magnet 101 on the other side of the flap. As the magnetic carrier 1402 builds up on one side of the flap, its increased volume increases a coupling force $F_{coupling}$ between the developer roller magnet and the carrier accumulating on the other side of the flap. A flexible flap, or rigid movable flap, will open under a sufficient force required to open the flap, $F_{open}$, that can be selected based on known physical characteristics of the flap such as its thickness, stiffness of material, as well as width and length. FIG. 14 illustrates the condition when the flap is closed as the carrier accumulates on one side of the flap 1402, $F_{coupling}<=F_{open}$. This condition prevents the toner dust from escaping through the slot in the scavenger electrode, as explained above. The flap opens when the carrier to developer roller coupling force exceeds the force needed to open the flap, $F_{coupling}>F_{open}$, and the accumulated carrier is allowed to travel through the slot entirely and fall back into the development station 1404. Without the force provided from the magnetic coupling between the carrier and the development roller, $F_{coupling}<=F_{open}$, a flexible flap returns to its closed position 1405 and prevents toner dust from escaping through the slot in the scavenger electrode. Alternatively, the flap can be closed by attaching a spring or a mechanized arm. The described implementation demonstrates the magnetic actuation of the flap.

Preferred embodiments of the flap, or door, should completely cover an opening or openings of variable geometry in the scavenger electrode, where the door or flap creates a seal between two different volumes, an inside volume (shown on the left of the scavenger electrode in the Figures herein) and an outside volume (shown on the right of the scavenger electrode in the Figures herein). The door or flap is preferably made from a material with no magnetic response and of sufficient rigidity to seal the opening when it is not flexed open. A preferred material of the door or flap is a polyester film of about 0.0015" to 0.005" thickness. The flap in a flexible flap embodiment should have a sufficiently low Modulus of Elasticity that it is easily deformed by low loads and is loaded well below the elastic limit for that material. The magnetic field being imposed on, or through, the flap or door should be normal to the flap or door surface and have a magnitude between about 500-700 Gauss at the flap. The flap or door should be allowed to bend, flex, or rotate (e.g. rigid embodiment) in a direction toward the source of the imposed magnetic field, revealing the opening covered by the flap. It can be attached by use of a mechanical hinge, or adhesive, or adhesive tape, or small nails or screws, or rivets, or other similar means so long as the flap acts as a seal to prevent toner dust from entering through the slot.

The flap or door should be such that when a sufficient amount of magnetic material is collected on the face of the flap or door that faces the outside volume, it creates a force between the magnetic material collected and the imposed magnetic field that is greater that the force necessary to keep the flap or door in contact with the inside face of the scavenger electrode. The flap or door, as described above, should return back to its original position after removal of the magnetic carrier from the flap or door. The flap or door should provide the motive closing force through deformation of the flap or door itself, or by its own weight, or by a mechanized device providing the closing force such as a motorized arm (not shown in the Figures), or by an external spring or some other such device that stores energy. If a mechanized (motorized) door, which can be rigid, is used then it can be timed and also used to open and close the flap or door at preselected intervals during printer use so that any accumulated carrier can be drawn, or attracted, through the slots.

It will be understood that, although specific embodiments of the invention have been described herein for purposes of illustration and explained in detail with particular reference to certain preferred embodiments thereof, numerous modifications and all sorts of variations may be made and can be effected within the spirit of the invention and without departing from the scope of the invention. Accordingly, the scope of protection of this invention is limited only by the following claims and their equivalents.

The invention claimed is:

1. A method for removing a buildup of a carrier on an electrode comprising:

providing a slotted scavenger electrode for collecting the carrier;

magnetically directing the carrier toward the slot in the scavenger electrode;

blocking the slot with a flexible flap, including accumulating the buildup to a volume sufficient for flexing open the flap, via the step of magnetically directing, causing the flap to flex open thereby allowing the carrier to travel through the slot and flexing closed the flap after the carrier has traveled through the slot.

2. The method of claim 1, further comprising the step of the carrier returning to a developer station after said step of allowing the carrier to travel through the slot.

3. The method of claim 1, further comprising the step of attaching the flexible flap to the scavenger electrode using an element selected from the group consisting of adhesive, adhesive tape, nails, rivets, screws, and a hinge.

4. The method of claim 1, wherein the step of blocking comprises the step of completely covering the slot with the flexible flap.

5. The method of claim 1, wherein the step of magnetically directing comprises imposing a magnetic field at an angle of about 90° to the flap.

6. The method of claim 1, wherein the step of magnetically directing comprises imposing a magnetic field at a magnitude of about 500 to 700 gauss as measured at the flap.

7. The method of claim 1, wherein said flexing open the flap includes deforming the flap from a resting position.

8. The method of claim 7, wherein said step of flexing closed the flap includes the step of allowing the flap to return to the resting position.

9. The method of claim 1, wherein said step of flexing closed the flap includes using a spring.

10. A method for removing a buildup of a carrier on an electrode comprising:

providing a slotted scavenger electrode for collecting the carrier;

magnetically attracting the carrier in a first direction toward the slot in the scavenger electrode;

blocking the slot with a movable flap for preventing toner dust from traveling through the slot in a second direction and for temporarily preventing the carrier from traveling through the slot in the first direction; and opening the movable flap including unblocking the slot and including allowing the carrier to travel through the slot via the step of magnetically attracting the carrier; and closing the movable flap after allowing the carrier to travel through the slot.

11. The method of claim 10, further comprising the step of the carrier returning to a developer station after said step of allowing the carrier to travel through the slot.

12. The method of claim 10, further comprising the step of attaching the movable flap to the scavenger electrode using an element selected from the group consisting of adhesive, adhesive tape, nails, rivets, screws, and a hinge.

13. The method of claim 10, wherein the step of blocking comprises the step of completely covering the slot with the movable flap.

14. The method of claim 10, wherein the step of magnetically attracting comprises imposing a magnetic field at an angle of about 90° to the movable flap.

15. The method of claim 10, wherein the step of magnetically attracting comprises imposing a magnetic field at a magnitude of about 500 to 700 gauss as measured at the movable flap.

16. The method of claim 10, wherein said step of opening the movable flap further includes accumulating the buildup of the carrier to a volume sufficient for said step of magnetically attracting the carrier to force open the movable flap.

17. The method of claim 10, wherein said step of closing the movable flap includes using a spring.

18. The method of claim 10, wherein said step of closing the movable flap includes using a mechanized arm.

* * * * *